US007152847B2

(12) United States Patent
Smith

(10) Patent No.: US 7,152,847 B2
(45) Date of Patent: Dec. 26, 2006

(54) PULLEY BLOCK

(75) Inventor: Giles Smith, Burnham-on-Crouch (GB)

(73) Assignee: Allen Brothers (fittings) Limited (GB)

( * ) Notice: Subject to any disclaimer, the term of this patent is extended or adjusted under 35 U.S.C. 154(b) by 127 days.

(21) Appl. No.: 11/051,526

(22) Filed: Feb. 4, 2005

(65) Prior Publication Data

US 2005/0181903 A1 Aug. 18, 2005

(51) Int. Cl.
*B66D 3/04* (2006.01)

(52) U.S. Cl. ..... 254/409; 254/415

(58) Field of Classification Search ..... 254/390, 254/405, 409, 410, 412, 413, 415, 416
See application file for complete search history.

(56) References Cited

U.S. PATENT DOCUMENTS 691,492 A * 1/1902 Roney ..... 254/409
3,526,389 A * 9/1970 Horgan, Jr. ..... 254/409
3,528,645 A * 9/1970 Harken ..... 254/412
3,773,295 A * 11/1973 Holmes ..... 254/409
3,806,094 A * 4/1974 Harken ..... 254/409
3,899,158 A * 8/1975 Johnson ..... 254/405
5,984,278 A * 11/1999 Hartlmeier ..... 254/415
6,974,125 B1 * 12/2005 Renton ..... 254/409

FOREIGN PATENT DOCUMENTS

GB 811599 4/1959
WO WO 03/008264 A1 1/2003

* cited by examiner

*Primary Examiner*—Emmanuel M Marcelo
(74) *Attorney, Agent, or Firm*—Renner, Kenner, Greive, Bobak, Taylor & Weber

(57) ABSTRACT

A pulley block has a body which rotatably supports a sheave, the block having a mounting pin which extends through a bore in the block. The pin has an enlarged head disposed internally of the body to retain the pin in the bore. Rotation of the pin may be prevented by a releasable locking arrangement comprising a groove formed transversely across the enlarged head of the pin and a lock member rotatably mounted in a hole extending within the block adjacent the head of the pin. The lock member is profiled for rotation between a locked position where a part of the lock member locates in the groove in the head of the pin to restrain rotation of the pin and a free position where the lock member is free of the head of the pin so that the pin may rotate.

14 Claims, 5 Drawing Sheets

PULLEY BLOCK

BACKGROUND OF THE INVENTION a) Field of the Invention

This invention relates to a pulley block and in particular a pulley block having a body rotatably supporting a sheave and a mounting pin by means of which the block may be connected to some other component.

Though the pulley block of this invention may be used in a variety of circumstances, it has a particular application in relation to racing dinghies. As such, it will be described exclusively with reference to that use, even though the invention is not to be regarded as limited to that use.

b) Description of the Prior Art

Pulley blocks are used extensively on the running rigging of racing dinghies, to assist in the hoisting and trimming of the sails. Such pulley blocks are required to have very low friction in order to minimise losses and also to have relatively low weights. Further, such blocks must have some kind of mounting arrangement, whereby the block may be connected to some other component of the dinghy.

A common mounting arrangement for a pulley block of the kind described above is to furnish the body of the block with a pin which projects from the block body, at right-angles to the axis of rotation of the pulley. Depending upon the intended use of the block, the pin may be provided with a variety of different connection arrangements but typically the pin will have a transverse hole externally of the block body and to which a shackle may be secured. In some blocks, the mounting pin is securely held against rotation with respect to the block body, whereas with others, the pin is freely rotatable with respect of the block body.

It has been recognised that there are advantages in providing a block with a mounting pin which may be allowed freely to rotate, but which may also be locked against rotation, as required by the sailor. Various mechanisms have been proposed for this and it is also known to provide a mechanism which allows a pin either freely to rotate with respect to the body or which is permitted only a limited range of movement. These mechanisms add to the overall weight of the block and may also reduce the reliability, when the block is being used under extreme conditions.

BRIEF SUMMARY OF THE INVENTION

Having regard to the above, it is a principal aim of the present invention to provide a pulley block having a mounting pin which is either freely rotatable with respect to the block body or may be locked against rotation, but which is relatively simple and does not add significantly to the overall weight of the block.

According to this invention, there is provided a pulley block having a body rotatably supporting a sheave, a mounting pin extending through a bore in the block which pin has an enlarged head disposed internally of the body to retain the pin in the bore. A locking arrangement is provided for the pin to restrain rotation of the pin with respect to the body. The locking arrangement includes a groove formed transversely across the head of the mounting pin and a lock member rotatably mounted in a hole extending within the block adjacent the head of the pin and substantially normally to the axis of said bore. The lock member is profiled for rotation between a locked position where a part of the member locates in the groove in the head of the pin and so restrains rotation of the pin, and a free position where the lock member is free of the head of the pin so that the pin may rotate in its bore.

BRIEF DESCRIPTION OF THE DRAWINGS

The drawings show a specific embodiment of pulley block constructed and arranged in accordance with this invention, though solely by way of example. In the drawings.

DETAILED DESCRIPTION OF THE INVENTION

With a block of this invention, adjustment either to permit the mounting pin freely to rotate or to lock the mounting pin against rotation is easily effected, merely by rotating the lock member typically through 180° between the free and locked positions. Further, as compared to a block having a freely rotatable pin, the block of this invention requires only the provision of the lock member together with suitable profiling of the head of the pin. As such, reliability of the block should not be compromised and there will be only a minimal increase in overall weight.

There may be two grooves formed across the head of the pin, at an angle to one another and preferably at right-angles to each other, such that the pin may be locked in a selected one of two possible angular orientations. Typically, and for the case of a pin having a transverse mounting hole externally of the block body, these positions will be with the transverse mounting hole extending either parallel to the rotational axis of the sheave, or at 90° to that axis.

The, or each if there is more than one, groove in the head of the mounting pin preferably is of part-circular shape, in cross-section. Then, the lock member may be mostly cylindrical and mounted such that the cylindrical surface of the lock member will be located in a groove in the head of the pin, so as to lock the pin against rotation. By providing the lock member with a relieved portion along its length and which may be brought adjacent the head of the pin by rotation of the lock member, the pin may be freed for rotation. To lock the pin once more, it should be set at the required position, rotationally, and then the lock member is turned through about 180°, so as to bring the cylindrical surface of the lock member once more into engagement with a groove in the head.

An embodiment of pulley block of this invention comprises a pair of opposed cheeks between which the sheave is rotatably supported, together with a bridging portion connecting the opposed cheeks. In this arrangement, the pin should be mounted within a bore in the bridging portion, with the lock member also mounted therein, immediately adjacent the head of the pin and with the axis of the lock member extending parallel to the rotational axis of the sheave. To permit the block to have minimal weight, the sheave may be in the form of an annulus rotatably supported by the cheeks, by means of respective opposed races formed on the internal surface of each cheek and on the outer surfaces of the annular sheave, with balls disposed between the respective opposed races. The block may be formed in two similar parts moulded from a plastics material and each defining one cheek, the two parts being held together by a clamping arrangement. Further, the lock member may also be moulded from a plastics material, so minimising an increase in weight of the block as compared to a simple block having a freely rotatable pin.

Figure 1:
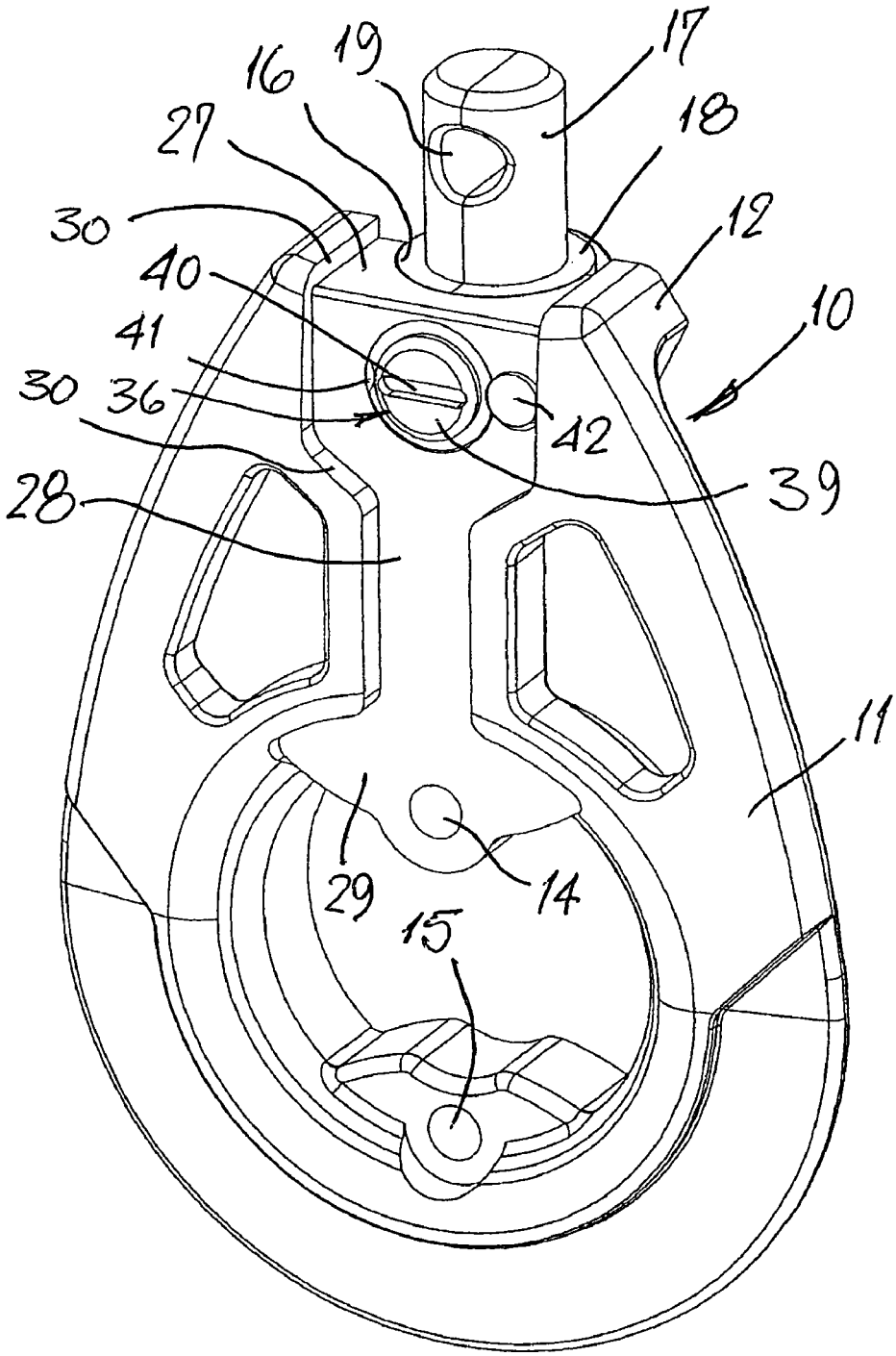
FIG. 1 is an isometric view of part of the embodiment of pulley block, from the outside and showing only one side cheek, a mounting pin and lock member, the sheave, the other side cheek and a connecting strap all having been removed for clarity.
Figure 4:
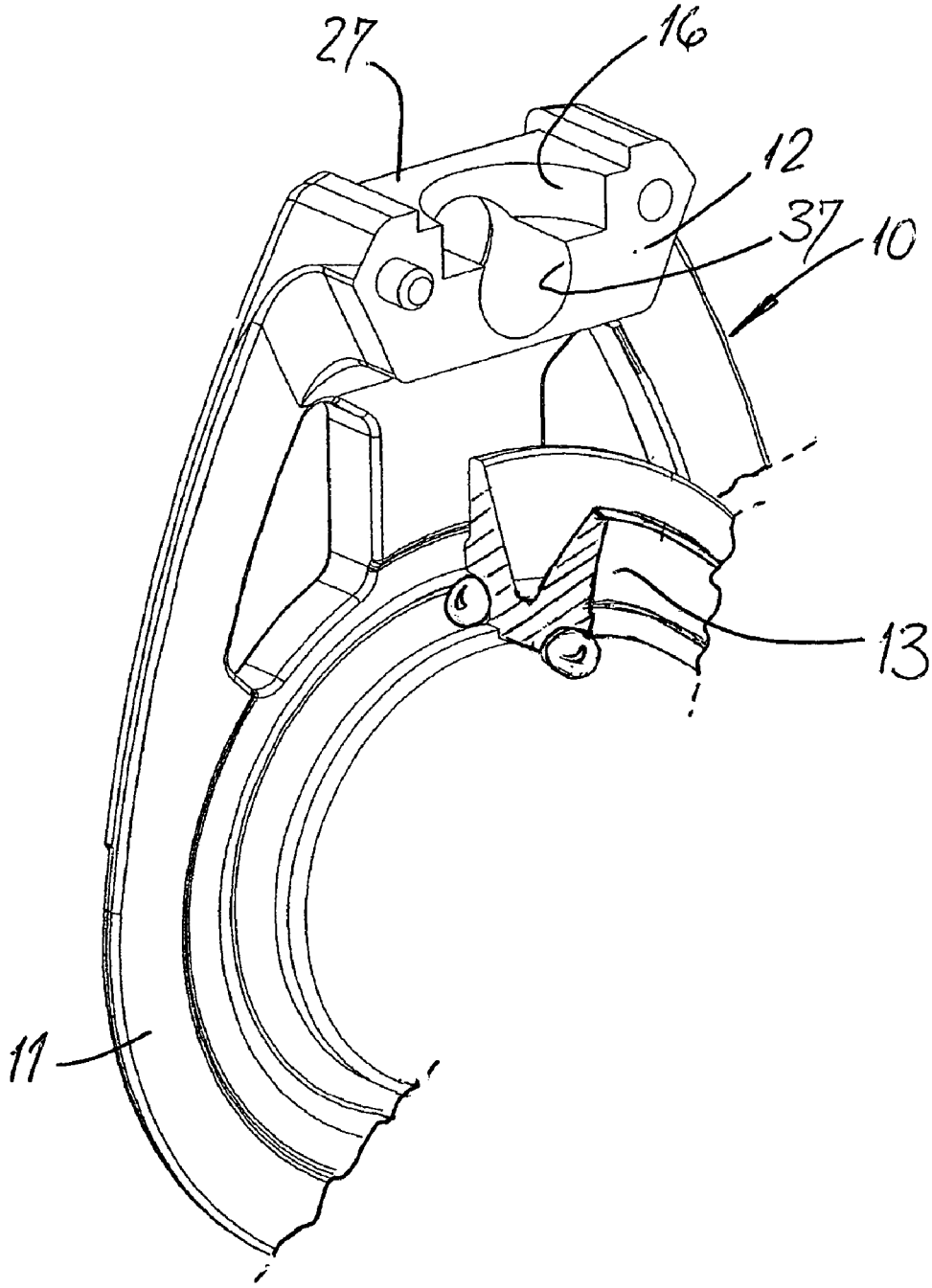
FIG. 4 is a partial rear view, with parts cut away, to show the mounting of the sheave on the side cheek.
Figure 5:
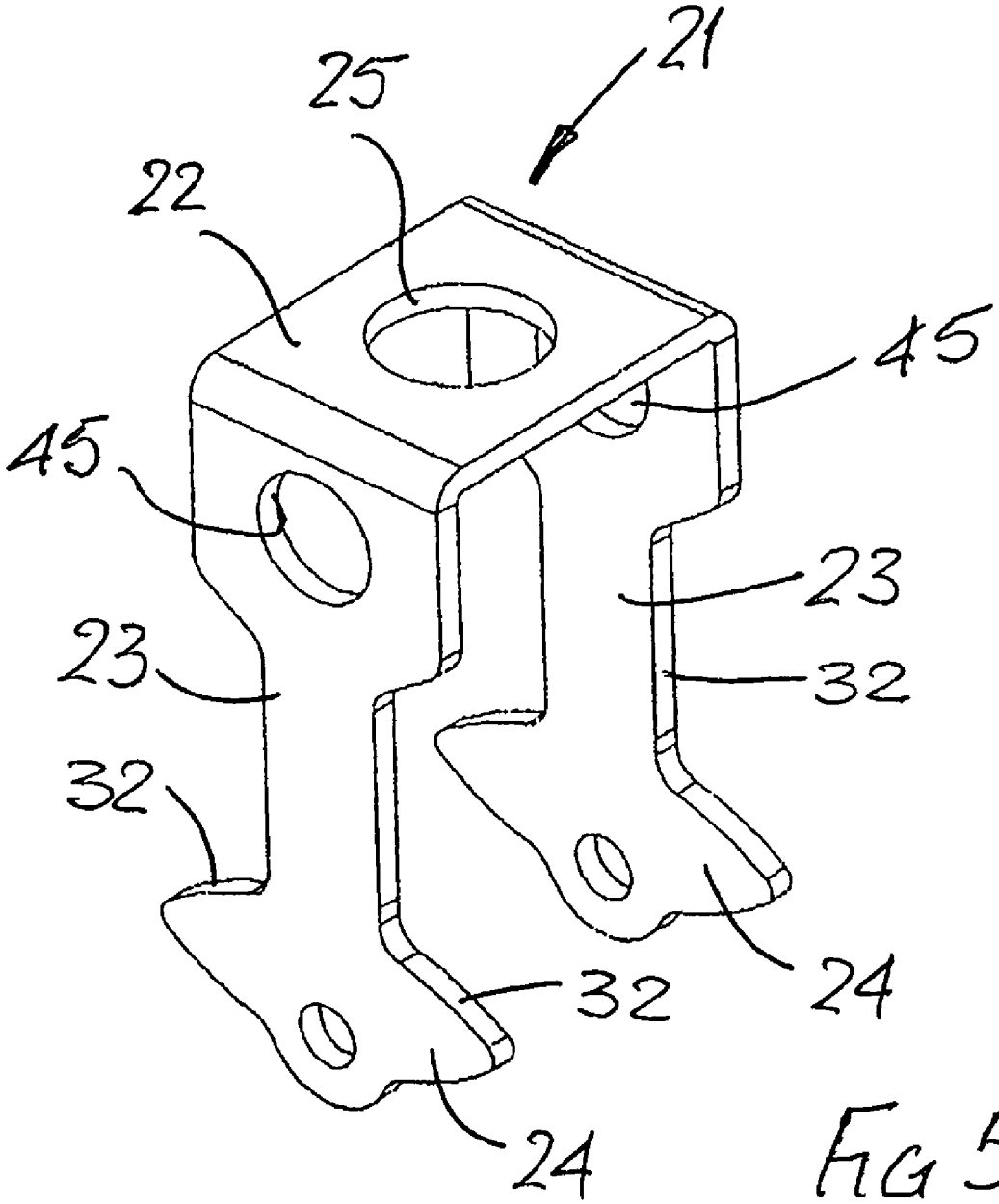
FIG. 5 is an isometric view of a connecting strap for use with a block having two side cheeks as shown in FIG. 1.

Referring now to the drawings, these show a preferred embodiment of pulley block of this invention. This pulley block has a pair of moulded plastics body parts 10 only one of which is shown in FIG. 1. Each body part defines a side cheek 11 and includes half of a bridging member 12 such that when the two body parts are fitted together, the bridging member is completed and serves to hold the two side cheeks 11 parallel and spaced apart by a distance sufficient to accommodate an annular rotatable sheave 13 (FIG. 4) therebetween, supported on balls running on races provided respectively on the side cheeks 11 and the sheave 13. The assembly of the two body parts 10 is held together by a metallic strap (FIG. 5, to be described below) and two bolts (not shown) or similar retaining fasteners extending through aligned holes 14, 15 in the two body parts and which will lie within the bore of the annular sheave of the completed block, the bolt which passes through hole 14 also passing through the metallic strap. For smaller blocks, it may not be necessary to provide two fasteners nor hole 15, as shown for example in FIG. 3.

The bridging member halves, when assembled to form the complete bridging member 12, define a bore 16 extending at right-angles to the axis of rotation of a mounted sheave. A mounting pin 17 has an enlarged head 18 which is accommodated in the bore 16, for free rotation with respect thereto. As shown in the drawings, the mounting pin has a transverse hole 19 externally of the block body, whereby the block may be attached to some other component by means of a shackle (not shown), the shackle pin extending through the hole 19 of the block mounting pin 17.

The pin 17 is retained in bore 16 by means of the U-shaped metallic strap 21 (FIG. 5) having a base section 22 from which extend two arms 23 substantially at right-angles to the base section. At its free end, each arm 23 has an enlarged portion 24, extending arcuately in the plane of the arm and symmetrically with respect to the length of the arm. Each enlarged portion 24 tapers in the arcuate direction away from the arm, and has a hole which registers with hole 14 of the body parts, when the strap is fitted thereto. The base section 22 has a central hole 25 through which the pin 17 passes, the diameter of the hole 25 being smaller than that of the enlarged head 18 of the pin. In this way, on completion of the block, loads are transferred by the strap from the body parts 10 to the pin 17.

Each body part 10 is provided with a groove dimensioned to accommodate the U-shaped strap 21, such that the external surface of the strap is essentially flush with the outer surface of the block body. The bridging member 12 includes a groove part 27 within which the base section 22 of the strap 21 extends, whereby the head 18 of the pin 17 may bear directly on the strap. Further, each cheek has a further groove part 28 to accommodate the respective arm 23 of the strap, that further groove part extending to the hole 14 and defining a recess 29 to accommodate the enlarged portion 24 of the strap. As shown in the drawings, the side walls 30 of the groove and recess extend essentially at right-angles to the major area of the groove; similarly, the side walls 32 of the strap 21 also extend at right-angles to the plane of the strap arms, whereby a close interfit may be achieved between the strap and the body parts defining the groove parts 28 and recess 29.

Figure 2:
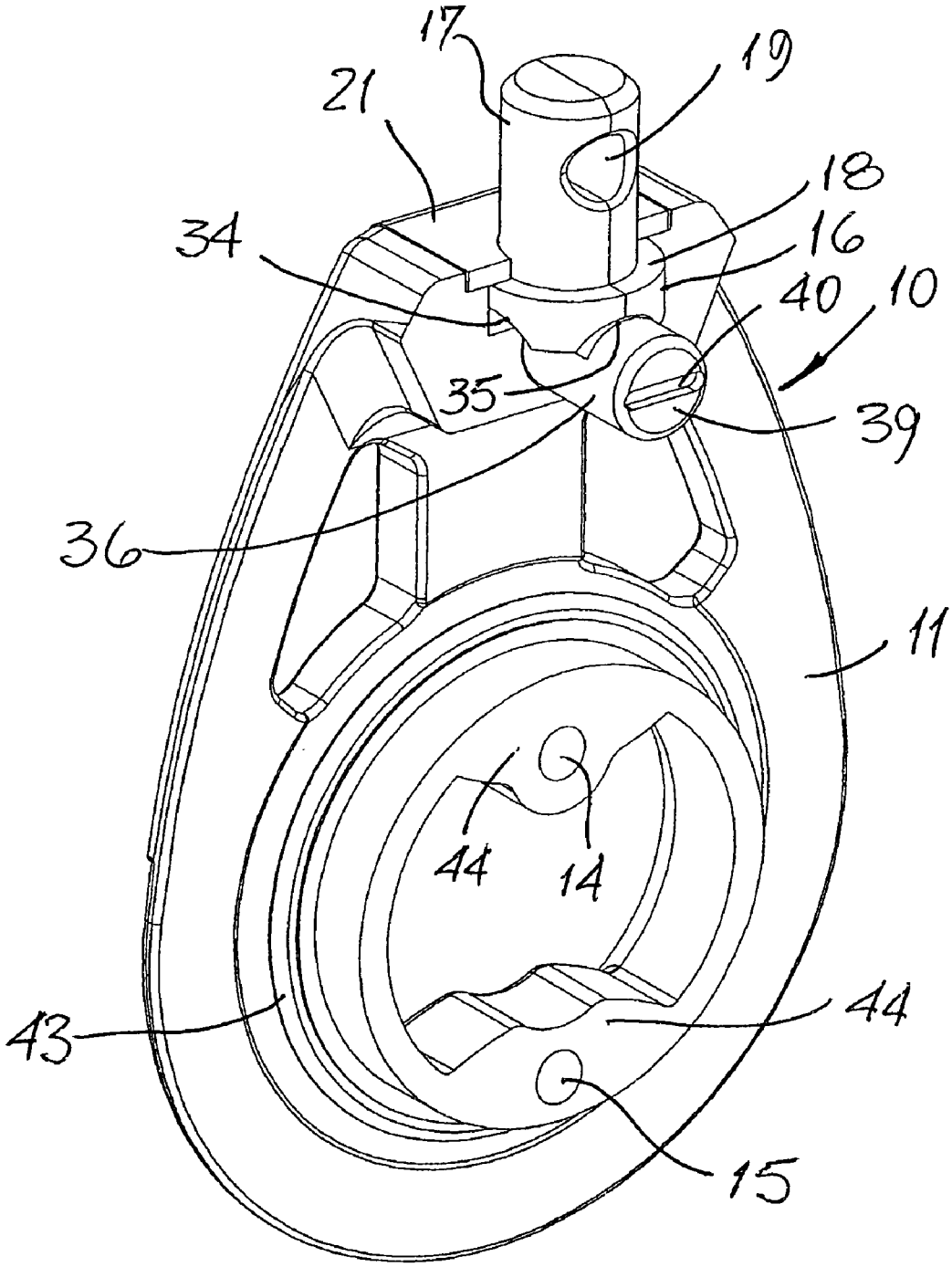
FIG. 2 is an isometric view on the assembly of FIG. 1, but from the other side and showing the mounting pin in a free setting.
Figure 3:
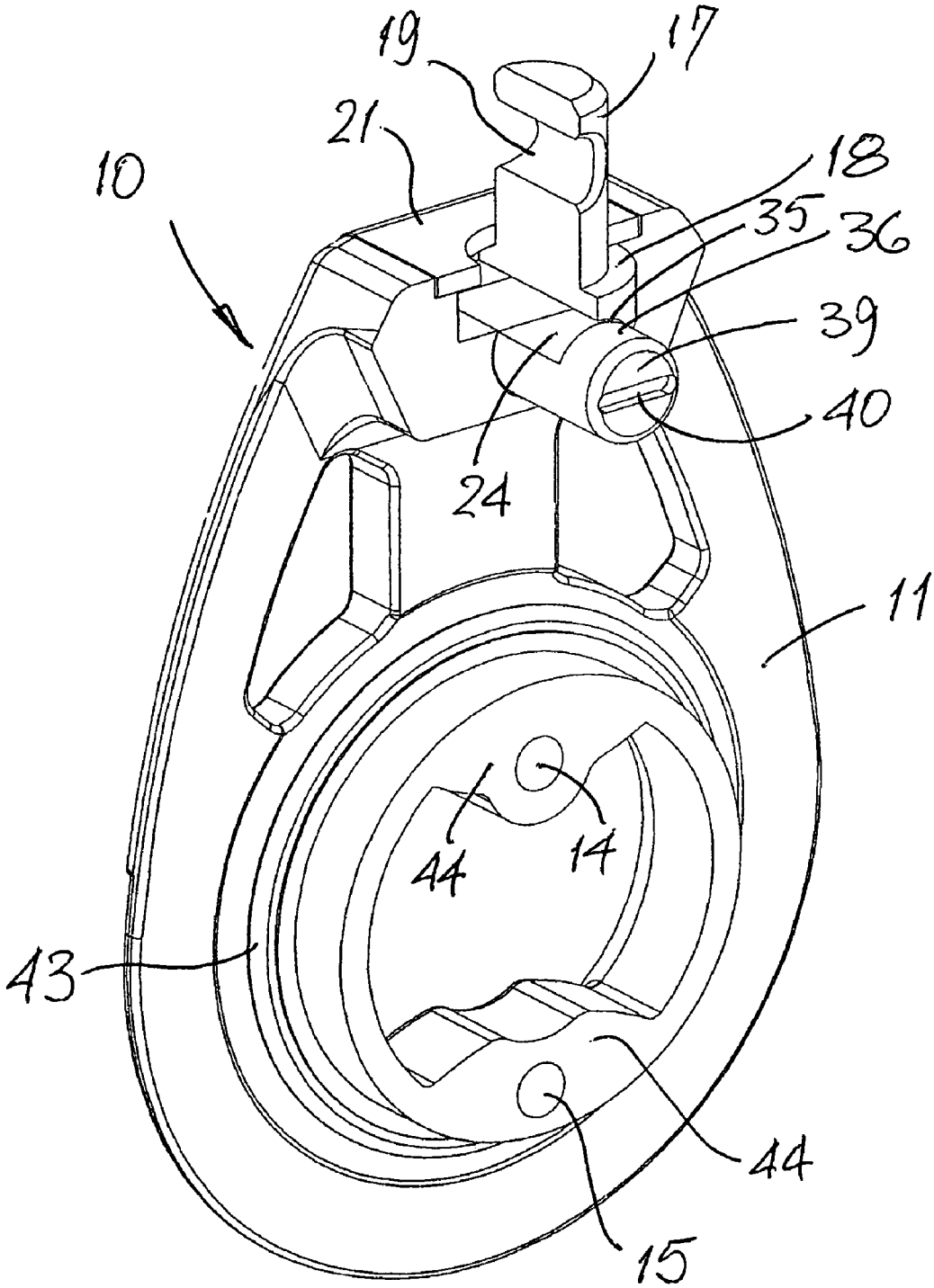
FIG. 3 is a view similar to that of FIG. 2 but with part of the mounting pin cut away to show in better detail the pin lock mechanism.

As shown in FIGS. 2 and 3, the enlarged head 18 of the mounting pin has two transverse grooves 34,35 extending at right-angles to each other across the end surface of the enlarged head 18. A lock member 36, generally of cylindrical form, extends through a bore 37 defined by the bridging member halves 12, which bore extends parallel to the rotational axis of a mounted sheave and with the axis of the bore intersecting the axis of bore 16 which carries the mounting pin 17. The lock member 36 has a relieved portion 38, formed by a cut-away sector in the cylindrical surface of the lock member, which relieved portion extends for a distance slightly greater than the diameter of the enlarged head 18.

Each end face 39 of the lock member 36 is provided with a transverse slot 40, engageable for example by a screwdriver to effect rotation of the lock member about its own axis. Two notches 41 are formed in the periphery of the lock member at the opposed ends of the slot 40, a slug 42 being let into the bridging member to interact with those notches, so giving two detent rotational positions for the lock member 36. Those positions respectively correspond to the relieved portion 38 being aligned with the enlarged head 18 of the mounting pin 17, and the relieved portion being diametrically opposed to that head. The strap 21 (FIG. 5) has two holes 45 formed in its arms 23 which register with the lock member 36 and serve to retain the lock member in its bore in bridging member 12, when the strap has been fitted to the block body.

As mentioned above, an annular sheave is carried between the side cheeks 11. The sheave is provided with outwardly-directed races adjacent its internal bore and each cheek is formed with a corresponding race 43 (FIGS. 2 and 3). A plurality of balls run on the facing races on the two sides of the sheave, thereby supporting the sheave for free rotation about its axis.

Sufficient strength is imparted to the body by means of the metallic strap (FIG. 5) which wraps round the two side cheeks 11 and over the bridging member formed by the two bridging member halves 12, the metallic strap being held in place by means of a fastening extending through the hole 14 nearer the mounting pin 17. The holes 14,15 are formed in thickened portions 44 of the side cheeks, which abut each other when the two body parts are fitted together, so forming a rigid structure. The enlarged head 18 of pin 17 bears directly on the strap, to impart loads thereto as required.

Once the pulley block has fully been assembled as described above, the mounting pin 17 may freely rotate with respect to the block body when the lock member 36 is set as shown in FIGS. 2 and 3. The lock member is held in that position by virtue of the interengagement of slug 42 with a notch 41 in the lock member 36. If the mounting pin 17 is to be locked against rotation, it is set to the required position with the transverse hole 19 either parallel to or at right-angles to the axis of the lock member, and then the lock member is turned through 180° by means of a screwdriver so as to engage the slug 42 with the opposed notch 41 in the lock member. This brings the cylindrical surface of the lock member into one of the grooves 34,35 in the enlarged head of the mounting pin, so securing the mounting pin against rotation with respect to the block body.

It will of course be appreciated that the locking arrangement for the mounting pin 17 may be used with other designs of block, besides those having an annular sheave as described above.

I claim:

1. A pulley block having a body, a sheave rotatably supported within the body, a mounting pin extending through a bore in the block, said pin having an enlarged head disposed internally of the body to retain the pin in the bore, and a locking arrangement for said pin to restrain rotation of the pin with respect to the body, wherein said locking arrangement comprises a groove formed transversely across the enlarged head of the mounting pin, a hole extending within the block adjacent the head of the pin and substantially normally to the axis of said bore, and a lock member rotatably mounted in said hole, the lock member being profiled for rotation between a locked position where a part of the lock member locates in said groove in the head of the pin and to restrain rotation of the pin and a free position where the lock member is free of the head of the pin so that the pin is rotatable in said bore.

2. A pulley block as claimed in claim 1, wherein the groove in the head of the mounting pin is of part-circular shape, in cross-section.

3. A pulley block as claimed in claim 1, wherein the lock member is mostly cylindrical but has a relieved portion, said relieved portion being brought into and out of register with the groove in the head of the pin by rotation of the lock member, respectively to permit and prevent rotation of the pin.

4. A pulley block as claimed in claim 1, wherein there are two grooves formed across the head of the pin, at an angle to one another.

5. A pulley block as claimed in claim 4, wherein the two grooves lie substantially at right-angles to each other.

6. A pulley block as claimed in claim 1, wherein the body comprises a pair of opposed cheeks between which said sheave is rotatably supported.

7. A pulley block as claimed in claim 1, wherein the lock member extends through the body and at least one end thereof is configured to permit the turning thereof at will between its locked and free positions.

8. A pulley block as claimed in claim 1, wherein there is provided a detent arrangement for the lock member, said detent arrangement defining two angularly-spaced positions for said lock member and corresponding to the locked and free positions of said pin.

9. A pulley block as claimed in claim 1, wherein the sheave is in the form of an annulus rotatably supported within the body of the block.

10. A pulley block as claimed in claim 9, wherein the block body defines a pair of spaced races and the sheave is provided with a pair of corresponding races to each side thereof, balls being disposed between the opposed races on the body and sheave respectively whereby the sheave is rotatably supported on the body.

11. A pulley block as claimed in claim 1, wherein the body is moulded from a plastics material.

12. A pulley block having a body, a sheave rotatably supported within the body, a mounting pin extending through a bore in the block said pin having an enlarged head disposed internally of the body to retain the pin in the bore, wherein said enlarged head has two grooves formed thereacross substantially at right angles to one another, the cross-section of each of said grooves being of a part-circular shape, and a locking arrangement for said pin to restrain rotation of the pin with respect to the body, said locking arrangement comprising a hole extending within the block adjacent the head of the pin and substantially normally to the axis of said bore, and a lock member rotatably mounted in said hole, said lock member being mostly cylindrical but having a relieved portion which is brought into register with a groove in the head of the pin by rotation of the lock member to prevent rotation of the pin, and moves out of register with said groove on further rotation of the lock member so that the pin is free to rotate in said bore.

13. A pulley block as claimed in claim 12, wherein the lock member extends through the body and at least one end of thereof is configured to permit the turning thereof at will between its locked and free positions.

14. A pulley block as claimed in claim 12, wherein there is provided a detent arrangement for the lock member, said detent arrangement defining two angularly-spaced positions for said lock member and corresponding to the locked and free positions of said pin.

* * * * *